US005860409A

United States Patent [19]

Grandveau et al.

[11] Patent Number: 5,860,409

[45] Date of Patent: Jan. 19, 1999

[54] GAS COOKSTOVE

[75] Inventors: Gilles Grandveau, Taverny; Alain Meslif, Saint Martin du Tertre, both of France

[73] Assignee: Gaz De France, Paris, France

[21] Appl. No.: 580,902

[22] Filed: Dec. 27, 1995

[30] Foreign Application Priority Data

Dec. 29, 1994 [FR] France ..... 94 15890

[51] Int. Cl.[6] ..... F24C 3/00

[52] U.S. Cl. ..... 126/39 R; 126/39 H; 126/39 K; 126/33; 126/37 R; 126/265

[58] Field of Search ..... 126/39 R, 39 H, 126/39 K, 33, 37 R, 265

[56] References Cited

U.S. PATENT DOCUMENTS

| | | | |
|---|---|---|---|
| 2,154,491 | 4/1939 | Chambers | 126/41 |
| 2,584,187 | 2/1952 | Crist | 126/37 R |
| 4,201,184 | 5/1980 | Scheidler et al. | 126/39 J |
| 4,413,611 | 11/1983 | Berlik et al. | 126/39 |
| 5,203,257 | 4/1993 | Goad | 126/377 X |
| 5,226,406 | 7/1993 | Reynolds | 126/39 |
| 5,381,729 | 1/1995 | Hennessy et al. | 126/33 X |

FOREIGN PATENT DOCUMENTS

| | | |
|---|---|---|
| 2436332 | 4/1980 | France . |
| 2565670 | 12/1985 | France . |
| 2241059 | 8/1991 | United Kingdom . |

*Primary Examiner*—Larry Jones
*Attorney, Agent, or Firm*—Pennie & Edmonds LLP

[57] ABSTRACT

A gas cookstove having in its top face an opening forming a recess for accommodating a removable container below which is mounted at least one gas burner supported by a tray retained on the edge of the recess like opening and interposed between a casing and the bottom of the removable container, the cookstove being applicable to the cooking of any foodstuff in a container removably fitted into the top of the cookstove.

8 Claims, 2 Drawing Sheets

4
18
17
9
19
14
36
7
31
17
26
27
15
28
23
29
30
15
8
12
24
25
13
10
6
20
11
16

22
15a
4
21
18
9
17
14
7
31
26
27
15
34
28
23
29
30
35
33
8
5
32
13
10
6
20
24

GAS COOKSTOVE

BACKGROUND OF THE INVENTION

The present invention relates essentially to an improved gas cookstove.

The evolution of the technique in the field of the cookstoves has been very small these last years.

In a general manner the cookstoves always have a single function for the cooking at the top namely the cooking of foodstuffs in vessels of various shapes on bare or uncovered fires.

Therefore one is still facing the problem of the cleaning of the top of the cookstove when there is an overflow of the containers. Moreover the heating is localized on the bottom of the vessel, so that the foodstuffs it contains may not be cooked in a homogeneous manner, i.e. with a heating taking place over the whole bottom and peripheral surface of the vessel.

Furthermore if one refers for instance to the document FR-A-2,004,693, there has already been proposed cookstoves the top face of which comprises an opening defining a recess adapted to accommodate a cooking container forming a deep fryer.

However the electrical heating resistor fastened upon the external face of the bottom of the container does not permit to consider this container as constituting a forthwith removable vessel, i.e. as a vessel which may at will and easily be placed within the opening of the cookstove and taken out of this opening, quite like a usual cooking vessel such as a saucepan which one sets quite simply upon the cookstove and which one withdraws after the cooking.

SUMMARY OF THE INVENTION

The object of the present invention is therefore to remedy the inconveniences stated hereinabove by providing an improved cookstove in the sense that it permits to integrate into the top part of the cookstove a vessel usely as simply as a conventional cooking vessel such as a saucepan or even a dish for serving cooked foodstuffs with in addition the advantage that the foodstuffs will be heated and cooked in a homogeneous manner and that the problems connected to the overflow will practically be removed.

For that purpose the subject of the invention is an improved gas cookstove the top face of which comprises at least one opening forming a recess adapted to accommodate a cooking container for any foodstuffs whatsoever, characterized in that underneath the container and inside of the cookstove is mounted at least one gas burner for heating the container removably mounted in its recess and forthwith extractable therefrom after the cooking of the foodstuffs contained in the container.

According to another characterizing feature of the invention, the gas burner located underneath the container is supported by a tray or the like retained upon the edge of the opening forming the accommodation for the said container.

This tray is interposed between a casing and the bottom of the container.

The cookstove of this invention is further characterized by a free space left between the edges of the tray and of the container for the escape of the combustion gases.

The aforesaid free space could be provided by causing the container to bear upon stops or the like made fast to the tray.

The aforesaid free space could also communicate with a chamber extending below the top face of the cookstove to form a container heating zone.

According to still another characterizing feature of the invention the casing and the tray comprise combustion air inlet openings.

The openings on the tray are formed in the sides of the latter and/or on bosses or the like provided in the bottom of the tray to avoid the foodstuffs overflows flowing through the said tray.

It should further be pointed out here that between the sides of the tray and the casing is arranged a wall forming a heat screen or shield and defining together with the casing a chamber receiving the elements for the control of the gas burner.

The casing will advantageously be provided at the upper portion with a sidelight permitting the visualization of the flame emitted by the burner.

The burner comprises a circular head mounted to extend through the bottom wall of the tray or constitutes a burner rail fastened onto the said bottom wall.

BRIEF DESCRIPTION OF THE DRAWINGS

The invention will be better understood and further objects, characterizing features, details and advantages thereof will appear better as the following explanatory description proceeds with reference to the accompanying diagrammatic drawings given by way of non limiting examples only illustrating several presently preferred specific embodiments of the invention and in which.

DETAILED DESCRIPTION OF THE INVENTION

Figure 1:
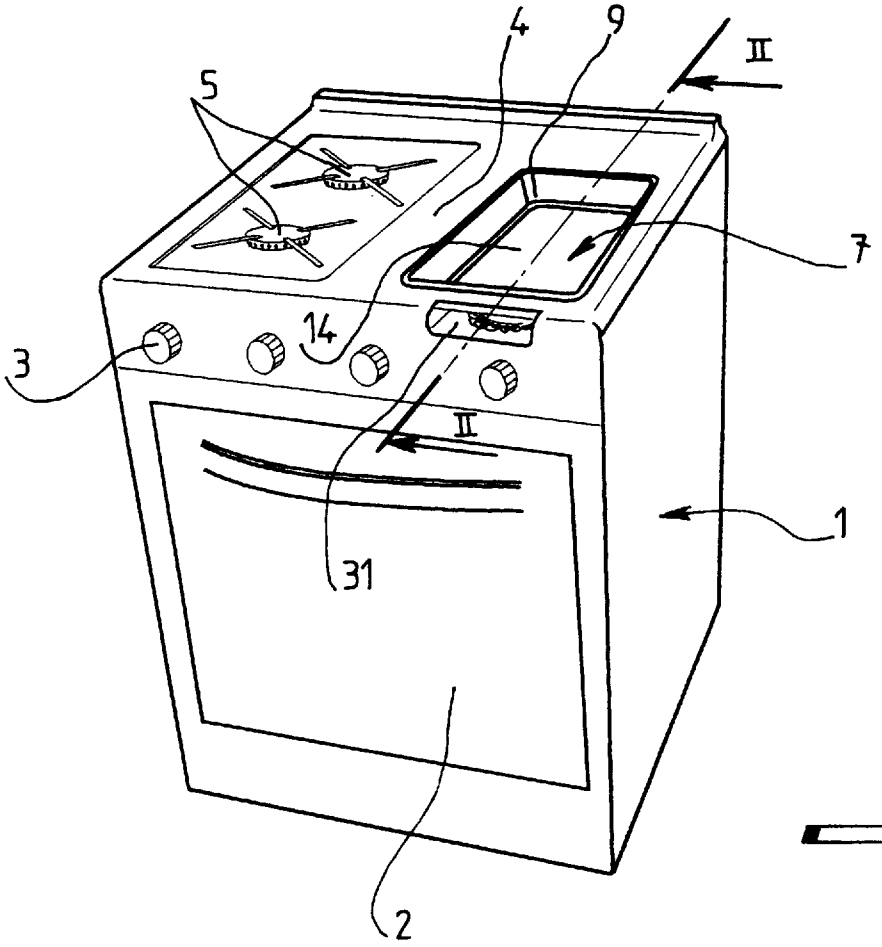
FIG. 1 is a diagrammatic perspective view of a gas cookstove fitted with the improvements according to the invention.

Referring at first to FIG. 1, there is seen a gas cookstove which according to the exemplary embodiment forms a parallelepipedic block 1 the front face of which is provided with a door 2 for access to an oven and with a plurality of knobs 3 for the control of the supply and the putting out of the gas feeding the burners of the cookstove.

According to the exemplary embodiment shown, the top face 4 of the cookstove is fitted with two conventional burner heads 5 the uncovered flame of which may heat any cooking vessels whatsoever placed upon the said heads.

As it is better seen on FIG. 2, the top face 4 of the cookstove 1 comprises an opening forming a recess 6 adapted to accommodate a container 7 allowing the cooking of any foodstuffs whatsoever and below which is mounted inside of the cookstove a gas burner generally designated at 8.

It is already important to point out here that the vessel 7 which according to the exemplary embodiment shown exhibits the shape of a rectangular pan is easily removably mounted in the recess 6 in a manner which will be described in detail subsequently and this so as to permit it being handled as simply as a conventional cooking container which is laid down upon an uncovered gas burner such as the burner 5.

It should further be pointed out that the upper edge 9 of the vessel or pan is substantially flush or level with the plane of the top face 4 of the cookstove 1.

Figure 2:
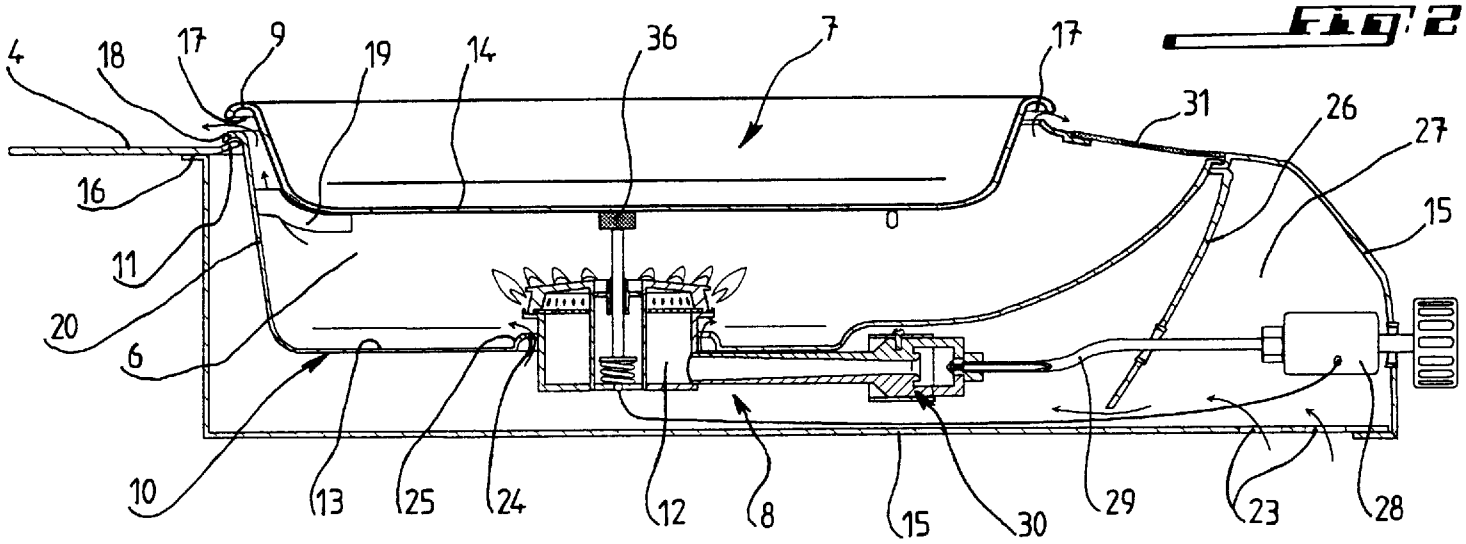
FIG. 2 is a view in section taken upon the line II—II of FIG. 1.

The gas burner 8 located underneath the vessel 7 is as is well seen on FIG. 2 supported by a tray or the like 10 retained upon the edge 11 of the opening forming an accommodation 6 for the said container.

More specifically the burner 8 comprises a circular head 12 which is mounted to extend through the bottom wall 13 of the tray 10, the said tray being interposed between the bottom wall 14 of the container 7 and a casing 15 made fast to the bottom of the top face 4 of the cookstove as is seen at 16.

Thus when the container 7 is placed by simply laying it down into the recess 6, the bottom wall 14 of this container forms together with the tray 10 the room 6 which constitutes a combustion chamber. Advantageously the combustion gases will be distributed in the chamber or room 6 for uniformly heating the whole outside surface of the container 7 so that the foodstuffs contained in this container will be heated and cooked in a homogeneous manner, which is not the case with the burners with a bare flame such as the burners seen at 5 on FIG. 1.

At 17 has been shown on FIG. 2 a free space provided between the upper edge 9 of the container 7 and the edge 18 of the tray 10, which edge 18 co-operates with the edge 11 of the opening formed in the top face 4 of the cookstove to thereby retain the tray 10.

The free space 17 left between the edges 9 and 18 allows the combustion gases within the room or chamber 6 to escape towards the outside atmosphere as physically shown by arrows on FIG. 2.

It is seen on this figure that the free space or escape space 17 is provided by the fact that the bottom wall 14 of the container or vessel 7 is bearing on stops or the like 19 made fast to the tray 10 and projecting towards the inside thereof.

It is perfectly conceivable without departing from the scope of the invention that the stops 19 be provided on the face underneath the bottom wall 14 of the container 7 and co-operate with the side wall 20 of the tray 10. In this latter case the stops could be shaped so as to form feet for the container 7 which therefore could constitute a hollow dish or a vegetable dish which may be laid directly down upon a table. The stops could also be an integral part of the burner 8, in which case the container would rest upon this burner through the medium of the said stops. But one could perfectly without departing from the scope of the invention cause the container 7 to rest directly upon the burner 8 which would then perform the function of a self-bearing burner.

According to another embodiment and as is clearly seen on FIG. 3, the free space 17 communicates with a chamber 21 which extends below the top face 4 of the cookstove and which opens rearwards of the latter as seen at 22 so as to permit the discharge of the hot gases. Thus the chamber 21 formed of the top face 4 of the cookstove and of a side extension 15*a* of the casing 15 advantageously constitute a zone allowing the reheating of the containers customarily used for cooking purposes, it being understood that the container(s) to be reheated should merely be placed upon the top face 4 of the cookstove above the chamber 21.

The casing 15 comprises in its bottom combustion-supporting air inlet openings 23. The tray 10 also comprises openings 24 forming ingresses for the combustion-supporting air.

Figure 3:
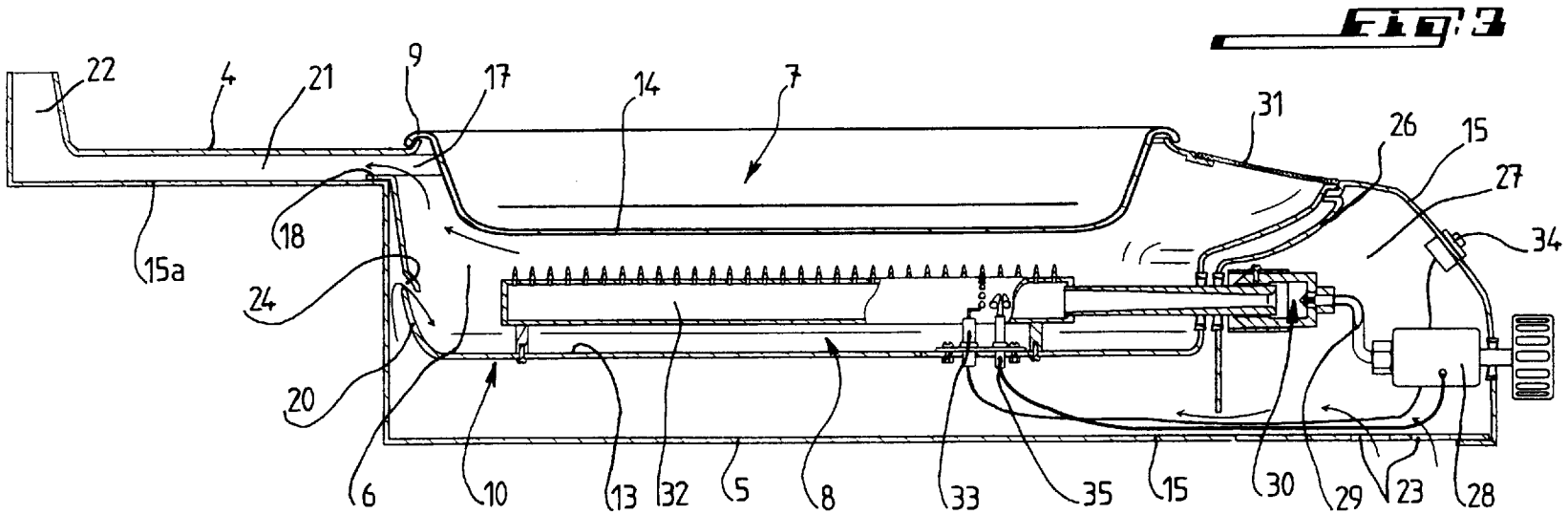
FIG. 3 is a view similar to FIG. 2 but showing another embodiment of the invention.

In the embodiment of FIG. 2, the openings 24 are formed at the top of a boss 25 provided on the bottom 13 of the tray 10 whereas in the embodiment of FIG. 3, the combustion-supporting air inlets 24 are provided on at least one of the sides 20 of the tray 10 which as previously explained allows to collect the overflows of foodstuffs.

Thus in one case as in the other one the air inlets 24 will prevent the flowing towards the casing 15 of the overflows of foodstuffs retained by the tray 10. In the embodiment of FIG. 2, it should be pointed out that the combustion-supporting air will be distributed about the head 12 of the burner 8 extending through the bottom 13 of the tray 10 at the level of the boss comprising the openings 24.

At 26 on FIGS. 2 and 3 has been shown a wall forming a heat shielding screen with respect to the recess 6 forming a chamber for the distribution of the hot gases about the container 7. This wall 26 defines together with the casing 15 a chamber 27 receiving the elements for operating the gas burner 8. These operating elements consist essentially of a thermostatic cock or valve 28. The latter is provided on a pipeline 29 connected to a unit 30 forming a Venturi system and gas injector which is connected to the burner 8 as well visible on FIGS. 2 and 3.

At the upper part of the casing 15 is provided a sidelight 31 which is seen on FIGS. 1, 2 and 3 and which advantageously allows to visualize the flame emitted by the burner 8.

In the embodiment of FIG. 3 have been used the same reference numerals to designate the elements common to those of FIG. 2.

This embodiment of FIG. 3 differs from that of FIG. 2 by the provision of the reheating chamber 21 already described and also by the arrangement of air inlet openings 24 in the tray 10, the path followed by the combustion-supporting air being physically shown by arrows on FIGS. 2 and 3.

Likewise the embodiment of FIG. 3 differs from that FIG. 2 in that the burner 8 here is a gas rail 32 located inside of the tray 10 and fastened through screws or any other suitable means onto the bottom wall 13. On FIG. 3 has been further shown a system for igniting the rail 32 which consists of an electrode 33 and of a remote control 34. The safety is provided by a thermocouple 35 which controls the gas shut off at the level of the cock or valve 28. It should be pointed out that the gas rail 32 allows the construction of the whole to be reduced in height and to provide for a good distribution of the heat in the combustion chamber 6 about the container 7.

It should further be pointed out that the edge 9 of the container 7 is directly bearing upon the top 4 of the cookstove.

Reverting to FIG. 2, there is seen at 36 a contact feeler or sensor which may co-operate with the bottom 14 of the removable container or pan 7 and is acting upon the gas flow rate of the thermostatic cock 28.

It should further be pointed out here that the upper edge 9 of the container 7 is bent outwards to advantageously form an antidrip or non-spill means which besides co-operates closely with the bent upper edge 18 of the tray 10 supporting the burner 8.

There has thus been provided according to the invention a gas cookstove fitted with a compact assembly with an easily removable container which may be heated in an homogeneous manner over its whole surface, the cleaning problems limiting themselves to the container proper as this would be the case with a usual cooking container. Moreover the heat source heating the container is in a way enclosed and there are no safety problems relating to the flame and likewise there is no risk of overturning the container. At last in case of overflows, it will suffice to clean the top of the cookstove about the container, it being understood that the overflows reaching the inside of the cookstove would be recovered or collected by the tray supporting the burner and this without any risk of obturation of the combustion-supporting air passage-way openings or ears.

The invention is of course not at all limited to the embodiments described and illustrated which have been given by way of example only.

Thus the gas burner could be fastened onto the casing instead of being fastened onto the tray. Likewise the cookstove could quite simply constitute a cooking block reduced to its simplest form, i.e. such as seen on FIGS. 2 and 3.

This means that the invention comprises all the technical equivalents of the means described as well as their combinations if the latter are carried out according to its gist and within the scope of the appended claims.

What is claimed is:

1. A cookstove comprising:

a top face;

a casing fastened to the bottom of said top face;

an opening in said top face forming a recess within said casing;

a cooking container accommodated in said recess;

a tray interposed between said casing and said cooking container, said tray supporting at least one burner, said tray cooperating with at least one stop protecting inwardly to accommodate said cooking container, wherein said cooking container forms openings with the edge of said tray on one side and with the edge of said casing on the other side.

2. A cookstove according to claim 1, wherein the cooking container and the tray form a free space.

3. A cookstove according to claim 2, wherein said free space communicates with a chamber extending underneath the top face of the cookstove to form a reheating zone.

4. A cookstove according to claim 1, wherein the tray comprises combustion-supporting air inlet openings.

5. A cookstove according to claim 4, wherein the tray comprises bosses located at the bottom of the tray for avoiding the flowing of overflows of foodstuffs through said tray and said inlet openings are formed on said bosses.

6. A cookstove according to claim 1, wherein between the tray and the casing is arranged a wall forming a heat screen and defining together with the casing a chamber receiving the elements for operating the gas burner.

7. A cookstove according to claim 1, wherein the casing is provided at the upper part with a sidelight allowing to visualize the flame emitted by the burner.

8. A cookstove according to claim 1, wherein the burner comprises a circular head mounted to extend through the bottom wall of the tray.

* * * * *

UNITED STATES PATENT AND TRADEMARK OFFICE
CERTIFICATE OF CORRECTION

PATENT NO. : 5,860,409

DATED : January 19, 1999

INVENTORS : Gilles GRANDVEAU et al.

It is certified that error appears in the above-identified patent and that said Letters Patent is hereby corrected as shown below:

Column 5, line 23 (claim 1, line 9): change "protecting" to --projecting--.

Signed and Sealed this

Twenty-second Day of June, 1999

*Attest:*

Q. TODD DICKINSON

*Attesting Officer*

*Acting Commissioner of Patents and Trademarks*